US010632641B2

(12) United States Patent
Endress

(10) Patent No.: US 10,632,641 B2
(45) Date of Patent: Apr. 28, 2020

(54) SLICING MACHINE COMPRISING A CHAIN FRAME SENSOR

(71) Applicant: Bizerba SE & Co. KG, Balingen (DE)

(72) Inventor: Frank Endress, Bisingen (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 15/801,364

(22) Filed: Nov. 2, 2017

(65) Prior Publication Data

US 2018/0169886 A1 Jun. 21, 2018

(30) Foreign Application Priority Data

Dec. 15, 2016 (EP) ..... 16204345

(51) Int. Cl.

| | |
|---|---|
| ***B26D 1/143*** | (2006.01) |
| ***B26D 7/26*** | (2006.01) |
| ***B26D 7/06*** | (2006.01) |
| ***B26D 7/32*** | (2006.01) |

(52) U.S. Cl.

CPC ..... *B26D 7/2635* (2013.01); *B26D 1/143* (2013.01); *B26D 7/0616* (2013.01); *B26D 7/32* (2013.01); *B26D 2210/02* (2013.01)

(58) Field of Classification Search

CPC ..... B26D 2210/02; B26D 7/0625; B26D 7/0623; B26D 7/0616; B26D 7/32; B26D 7/2635; B26D 1/143

See application file for complete search history.

(56) References Cited

U.S. PATENT DOCUMENTS

| | | | | |
|---|---|---|---|---|
| 4,763,738 | A * | 8/1988 | Kuchler | B26D 7/30 177/120 |
| 2002/0030482 | A1* | 3/2002 | Iwamoto | G01P 3/443 324/174 |
| 2002/0081124 | A1* | 6/2002 | Kuwata | G03G 15/6502 399/107 |
| 2003/0145700 | A1* | 8/2003 | Lindee | B26D 7/32 83/29 |

(Continued)

FOREIGN PATENT DOCUMENTS

| | | | |
|---|---|---|---|
| DE | 102008006688 | B4 | 8/2011 |
| EP | 2322331 | A1 | 5/2011 |
| WO | WO 2008135219 | A1 | 11/2008 |

*Primary Examiner* — Andrea L Wellington
*Assistant Examiner* — Fernando A Ayala
(74) *Attorney, Agent, or Firm* — Leydig, Voit & Mayer, Ltd.

(57) ABSTRACT

In an embodiment, the present invention provides an electrically operated slicing machine for cutting slices of material to be cut, in particular elongate material to be cut, preferably food, including: a cutting device, including a circular knife that is mounted in a machine housing and rotates in a cutting plane about a first axis of rotation; a stop plate, which is parallel to the cutting plane and is movable in an x direction, for setting the cutting thickness; a carriage, which supports a bearing plate having a bearing surface on which the material to be cut is placed, which carriage can travel in parallel with the cutting plane E; and a chain frame, which is operated by a chain frame motor, for depositing slices that have been cut off from the material to be cut on a deposition table, the chain frame being detachably connected to the machine housing.

19 Claims, 3 Drawing Sheets

(56) References Cited

U.S. PATENT DOCUMENTS

| | | | | |
|---|---|---|---|---|
| 2008/0016999 | A1* | 1/2008 | Mathues | B26D 7/01 83/42 |
| 2008/0168880 | A1* | 7/2008 | Kuperman | A21C 5/003 83/870 |
| 2013/0019722 | A1* | 1/2013 | Eyles | B26D 7/30 83/13 |
| 2018/0281146 | A1* | 10/2018 | Tomonaga | B24B 23/022 |

* cited by examiner

SLICING MACHINE COMPRISING A CHAIN FRAME SENSOR

CROSS-REFERENCE TO PRIOR APPLICATION

Priority is claimed to European Patent Application No. 16 204 345.9, filed on Dec. 15, 2016, the entire disclosure of which is hereby incorporated by reference herein.

FIELD

The invention relates to an electrically operated slicing machine for cutting slices of material to be cut, in particular elongate material to be cut, preferably food, comprising a cutting device, which comprises a circular knife that is mounted in a machine housing and rotates in a cutting plane E about a first axis of rotation x, comprising a stop plate, which is parallel to the cutting plane E and is movable in the x direction, for setting the cutting thickness, comprising a carriage, which supports a bearing plate having a bearing surface on which the material to be cut is placed, which carriage can travel in parallel with the cutting plane E, and comprising a chain frame, which is operated by means of a chain frame motor, for depositing slices that have been cut off from the material to be cut on a deposition table, it being possible to detachably connected the chain frame to the machine housing.

BACKGROUND

A slicing machine comprising a chain frame connected to the machine housing is known from DE 10 2008 006 688 B4, for example.

The material to be cut, in particular in electrically operated slicing machines for elongate foods such as sausages, ham, salmon, cheese, etc. is moved towards the cutting device, usually in the x direction perpendicular to the cutting plane in which a rotary circular knife normally rotates in order to cut slices off from the conveyed material to be cut. Said material is cut into slices by the circular knife, which are then picked up by the chain frame and deposited on the deposition table by a slicer.

The thickness of the slices can be preset by moving the stop plate in the x direction.

The stop plate is also usually moved in the x direction into a maximum end movement position so as to be able to clean and/or sharpen the circular knife more easily, for example.

If particularly thick slices are to be cut, for example when cutting meatloaf slices or the like, or if the stop plate is to be moved into its maximum movement position, a conflict of space can occur between the stop plate and, in particular, the chain frame arranged next to said plate.

Therefore, the person operating the slicing machine usually detaches the chain frame first of all, before moving the stop plate into the maximum movement position, in order to make room for the stop plate, and will also re-mount the chain frame on the machine housing after the particular use, i.e. cutting thick slices or cleaning and/or sharpening the circular knife, has finished.

Modern slicing machines now often offer the operator the possibility of being able to select different operating modes via an operator interface, for example. Operating modes can in particular be a normal operating mode for cutting normal slices and a service mode, in which particularly thick slices can be cut and/or the circular knife can be cleaned and/or sharpened. The chain frame is detached from the machine housing in the service mode and is mounted thereon in the normal operating mode.

The difficulty here is that, although some of the operating modes can be selected, when setting the slicing machine to such an operating mode, the operating sequence can be disrupted.

In particular, the chain frame and the stop plate may collide if the operator forgets to detach the chain frame before using the slicing machine in the service mode. This collision can even break the slicing machine. Conversely, normal slices cannot be cut properly if the chain frame has not (yet) been mounted on the machine housing, for example following a service mode.

SUMMARY

In an embodiment, the present invention provides an electrically operated slicing machine for cutting slices of material to be cut, in particular elongate material to be cut, preferably food, comprising: a cutting device, comprising a circular knife that is mounted in a machine housing and rotates in a cutting plane about a first axis of rotation; a stop plate, which is parallel to the cutting plane and is movable in an x direction, for setting the cutting thickness; a carriage, which supports a bearing plate having a bearing surface on which the material to be cut is placed, which carriage is configured to travel in parallel with the cutting plane E; and a chain frame, which is operated by a chain frame motor, configured to deposit slices that have been cut off from the material to be cut on a deposition table, the chain frame being detachably connected to the machine housing, wherein the slicing machine comprises a sensor device configured to detect a current mounted status of the chain frame.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
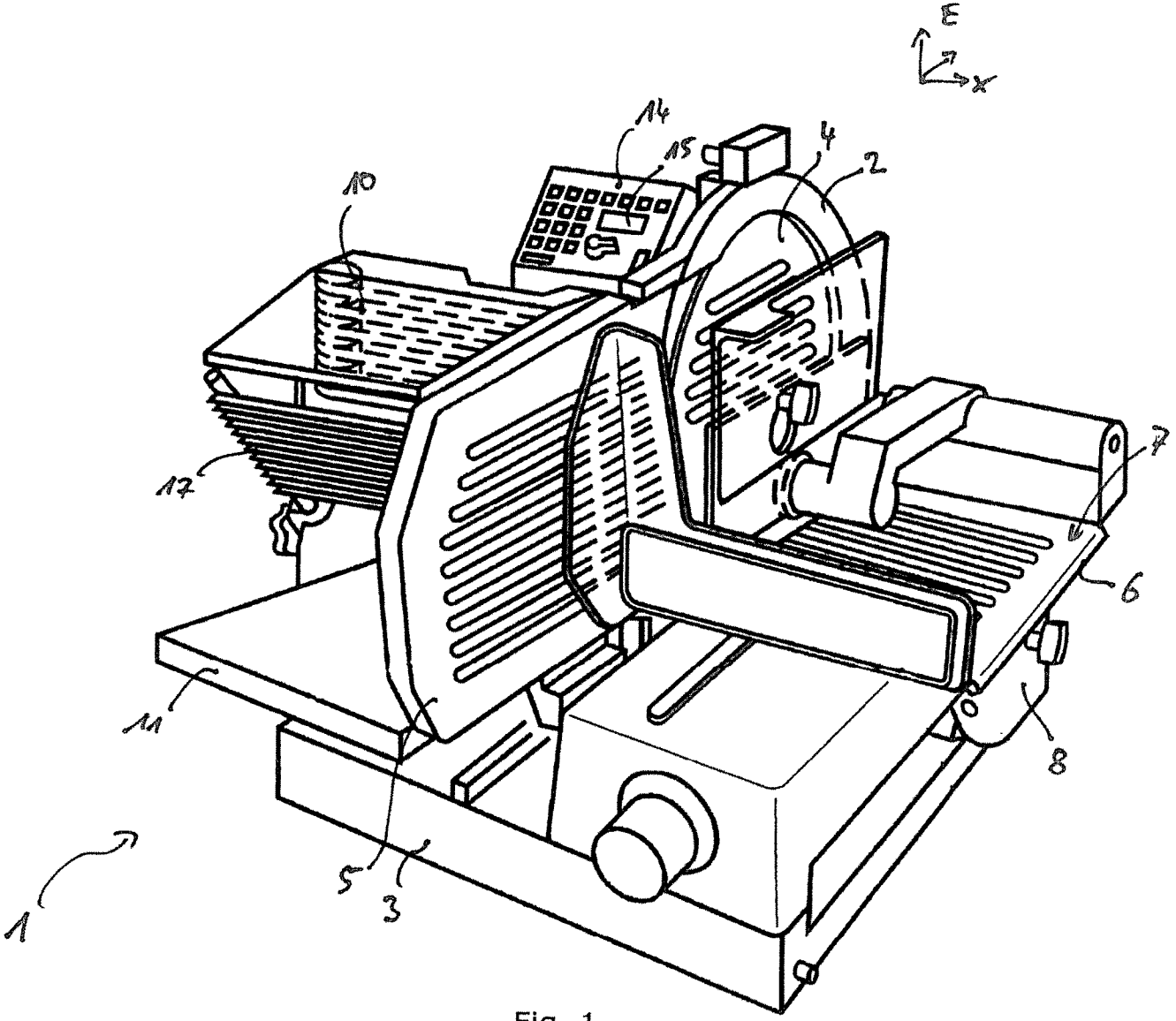
FIG. 1 shows a slicing machine comprising a chain frame.

According to the invention, this object is achieved in a manner that is as surprisingly simple as it is effective, in that the slicing machine comprises a sensor device for detecting the current mounted status of the chain frame.

The sensor device can therefore unequivocally and automatically detect whether the chain frame is mounted on the machine housing or not.

An operating mode can then be selected and/or set on the basis of a status signal generated by the sensor device.

In this case, it is particularly advantageous for a control device to be provided, which controls movement of the stop plate in the x direction for setting the cutting thickness, and in that the control device blocks the stop plate from moving beyond a set maximum movement distance if the sensor device detects that the chain frame is currently mounted, so that the stop plate can only be moved beyond this threshold value when the chain frame has been removed from the machine housing.

Such a control device can be produced very simply, for example by means of a computer unit or a microcontroller. In particular, the control device can control the movement of said plate by means of the sensor device, thus effectively preventing the operating sequence from being interrupted, as described at the outset.

A signal-issuing unit, preferably a visual display unit, can be provided, on which the current status signal of the chain frame can be displayed for an operator. The status signal can be sensed by the sensor device for this purpose, and can be processed in order to be displayed on the signal-issuing unit. The signal-issuing unit can be a visual display unit and/or an acoustic output unit, for example a loudspeaker having a sound-generating unit. The signal-issuing unit can preferably be actuated by the control unit.

For example, a list of selectable or admissible operating modes dependent on the status signal and/or an enabling or disabling signal can then be displayed on the signal-issuing unit.

Additional information can also be displayed to the operator on the signal-issuing unit, in particular the display unit. If, for example, a service mode is selected or started, an information signal indicating that the chain frame needs to be detached may appear, in particular until the chain frame has actually been detached. If the slicing machine switches back to the normal operating mode, an information signal indicating that the chain frame needs to be mounted may appear, in particular until the chain frame has actually been mounted.

In particularly advantageous embodiments, the sensor device comprises a current-measuring apparatus, preferably for measuring the chain frame motor current. The status signal can then be generated by measuring the chain frame current. In light of past experience, the chain frame motor current exceeds a definable minimum current value when the chain frame is mounted and the motor thereof is in operation, for example since a greater amount of power needs to be applied in order to move the chains of the chain frame. Therefore, the status signal can be deduced from the chain frame motor being placed into operation and from the current demand thereof being measured. The minimum current value can be predefined in a self-learning manner, in particular by a self-learning apparatus. An instantaneous value and/or an average current value, which is measured in particular over a settable period of time, can be provided as the chain frame motor current.

Alternatively or in addition, the sensor device can also comprise a magnetic field sensor, preferably a Hall-effect sensor, which preferably interacts with a magnet mounted on the chain frame. The mounted status of the chain frame can therefore be determined by means of a magnetic signal.

Electrically measuring the motor current in order to determine the mounted status and/or using magnets to determine the mounted status is also advantageous in that the mounted status can be determined without contact. Practice has shown that, particularly in slicing machines for slicing meat, sausage or cheese, for example, specific hygiene requirements exist and dirt, cutting residues or the like always need to be taken into account. Contactless determination can be substantially error-free even under such conditions, and hygiene requirements can be easily met.

It is possible to determine the status signal electromechanically when the sensor device comprises a mechanical, in particular electromechanical, switch for detecting the current mounted status of the chain frame.

In this case, the electromechanical switch can be formed as a roller switch or as a contact switch. Such switches are available at a reasonable price and offer extremely low-interference operation over a long service life.

For this purpose, the chain frame can be detachably attached to the machine housing via at least one attachment point, which is preferably formed as a pin or as an eye.

At least part of the sensor device can be integrated in the attachment point. For example, part of the contact switch can be integrated in the attachment point. If the chain frame is then attached to the machine housing by means of the attachment point, the contact switch can be actuated automatically and can therefore establish that the chain frame is mounted. Accordingly, the contact switch can automatically establish that the chain frame has been detached when it is not attached by means of the attachment point. For this purpose, the attachment point can be formed as a pin, for example, which engages in a complementary recess that triggers electrical contract when the chain frame is mounted. It is likewise conceivable for the attachment point to be formed as an eye, whereby, in such an embodiment, the contact switch advantageously engages in the eye, for example by means of its pin-shaped design, when the chain frame is mounted, thus producing electrical contact.

If the chain frame can be detached from the machine housing for example by being moved to a removal position, as an alternative or in addition, the roller switch can detect that a default position has been passed over, which can be an indication that the removal position has been reached, and the mounted status of the chain frame can be determined therefrom.

The invention also relates to a method for controlling an electrically operated slicing machine for cutting slices of material to be cut, in particular elongate material, preferably food, comprising a cutting device, which comprises a circular knife that is mounted in a machine housing and rotates in a cutting plane E about a first axis of rotation x, comprising a stop plate, which is parallel to the cutting plane E and is movable in the x direction, for setting the cutting thickness, comprising a carriage, which supports a bearing plate comprising a bearing surface on which the material to be cut is placed, which carriage can travel in parallel with the cutting plane E, and comprising a chain frame, which is operated by means of a chain frame motor, for depositing slices that have been cut off from material to be cut on a deposition table, it being possible to detachably connect the chain frame to the machine housing, the invention stipulating that at least one operating mode of the slicing machine is either enabled or blocked on the basis of a status signal from a sensor device for detecting the current mounted status of the chain frame.

In particular, a service mode can be enabled or blocked. The service mode can in particular allow for thick slices to be cut. Thick slices can be understood to mean slices that are more than 10 mm, in particular more than 12 mm, thick.

By means of the method according to the invention, the causes of a possible interruption of the operating sequence, as described at the outset, can already be prevented. For example, the operating mode for cutting thick slices can be blocked for as long as the status signal shows that the chain frame is mounted. A conflict of space between the stop plate and the chain frame can thus then be prevented from the beginning.

The user can also be informed about the mounted status when, in the blocked operating mode, a disabling signal or, in the enabled operating mode, an enabling signal, is displayed to the operator, preferably visually displayed on a display unit. The disabling signal can also be formed as an information signal stating that the chain frame needs to be detached, for example. The enabling signal can be an information signal indicating that the current operating mode is enabled or usable.

The method is particularly favorable in situations in which a possible conflict of space is very likely. Therefore, is it particularly advantageous for a service mode in particular, preferably a sharpening program or a movement of the stop plate in order to set larger cutting thicknesses, to either be enabled or blocked as the operating mode.

For this purpose, the status signal can be determined by the chain frame motor current being measured by means of a current-measuring apparatus of the sensor unit.

The operating mode, in particular a sharpening program or a program for cutting slices having a preset minimum thickness, can then be enabled when the chain frame current leaves a predefined current value range, preferably when the chain frame current falls below a predefined threshold current value. Since said current falling below the threshold value can be assumed to mean that the chain frame motor is only slightly loaded, the current falling below the threshold value can be a sign that the chain frame has been detached.

In a particularly advantageous variant of the method, when a status signal from the sensor device indicates that the chain frame is currently mounted, movement of the stop plate beyond a set maximum movement distance is automatically blocked, and the stop plate can only move beyond this threshold value when the chain frame has been removed from the machine housing. For example, a mechanical lock can reduce or increase the free movement path on the basis of the status signal. A conflict of space, in particular between the chain frame and the stop plate, can therefore automatically be prevented.

The sensor device can also particularly advantageously supply a continuous status signal and/or a multivalent status signal, in particular having more than two status steps. For example, it is then not only possible to detect whether or not the chain frame is mounted. For example, it is then also possible to detect, in particular in a chain frame that can move in the x direction, whether or how far the chain frame has moved in the x direction. Therefore, an operating mode can also be enabled, for example, if, although the chain frame is still mounted, it has moved far enough in the x direction that enough free space is available for the stop plate to move.

Additional features and advantages of the invention can be found in the following detailed description of embodiments of the invention and variants of the method according to the invention, on the basis of the drawings, which show details of the invention, and in the claims. In variants of the invention, the individual features can either be implemented on their own or together in any combinations.

In the drawings, corresponding reference numerals are used for corresponding elements for easier understanding of the invention.

FIG. 1 shows an electrically operated slicing machine 1 for cutting slices of material to be cut, in particular elongate material, preferably food, comprising a cutting device 2, which comprises a circular knife 4 that is mounted in a machine housing 3 and rotates in a cutting plane E about a first axis of rotation x, comprising a stop plate 5, which is parallel to the cutting plane E and is moveable in the x direction, for setting the cutting thickness, comprising a carriage 8, which supports a bearing plate 6 comprising a bearing surface 7 on which the material to be cut is placed, which carriage can travel in parallel with the cutting plane E, and comprising a chain frame 10, which is operated by means of a chain frame motor 9 (details see FIG. 2), for depositing slices that have been cut off from material to be cut on a deposition table 11.

The chain frame 10 can be detachably connected to the machine housing 3. In particular, the chain frame 10 can be lifted up and detached.

Furthermore, a signal-issuing unit 14 comprising a visual display unit 15 can be seen. The signal-issuing unit 14 also comprises a loudspeaker, by means of which acoustic signals can be issued. Said signal-issuing unit also comprises a keypad, by means of which operating modes and operating parameters (e.g. desired slice thickness, cutting speed, etc.) of the slicing machine 1 can be selected or set by an operator.

FIG. 1 also shows a slicer 17.

Figure 2:
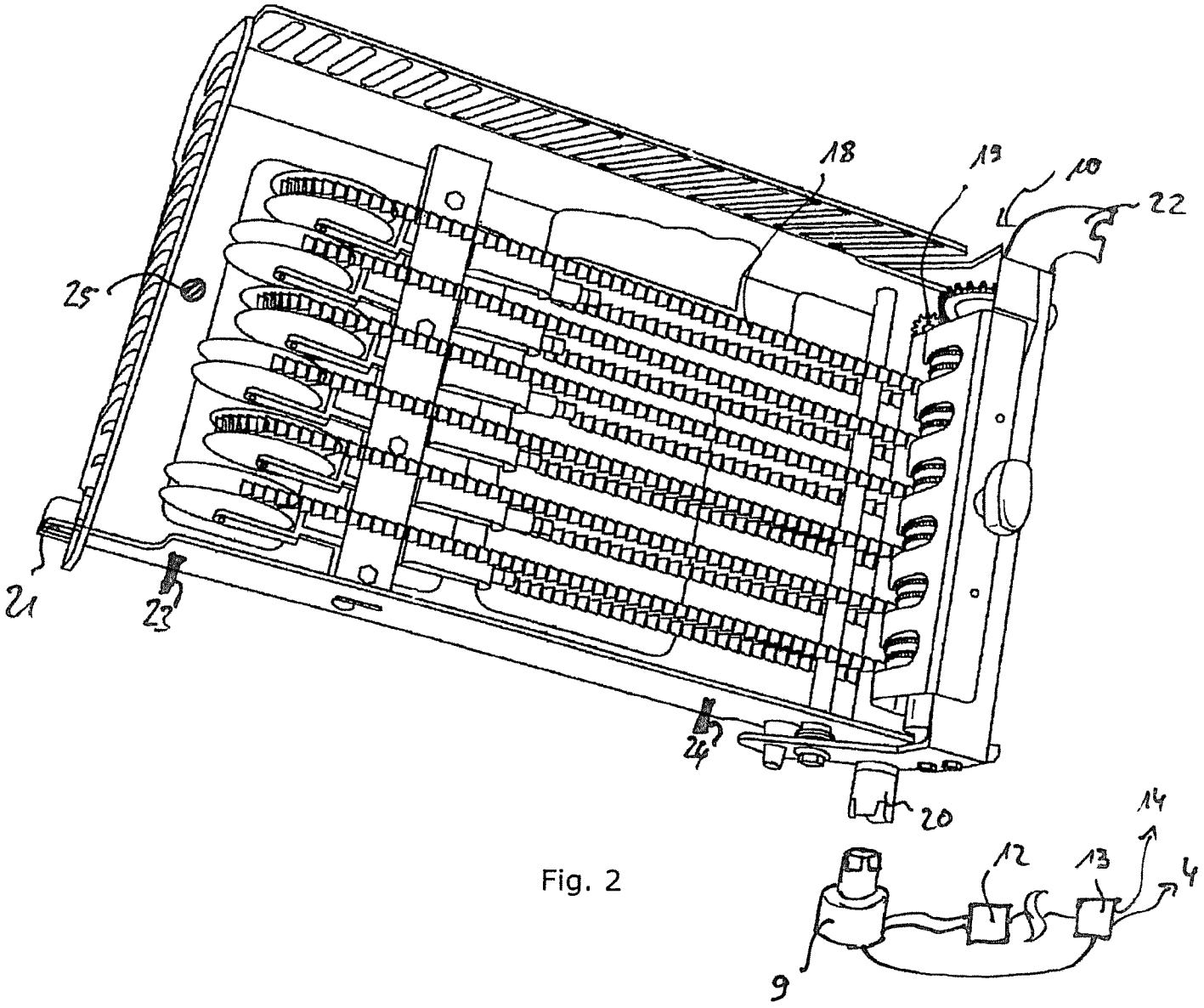
FIG. 2 shows the chain frame of the slicing machine in FIG. 1.

FIG. 2 is a detailed view of the chain frame 10 of the slicing machine 1.

Transport chains 18, which can be connected to the chain frame motor 9 by means of a drive apparatus 19 and a motor coupling 20 and can be operated by said motor when connected thereto, can be seen.

In this case, the motor coupling 20 is designed such that, when the chain frame 10 is mounted on the machine housing 3, it non-positively engages in a complementary mating part of the chain frame motor 9.

In contrast, when the chain frame 10 is removed or detached, the motor coupling 20 is automatically mechanically disconnected from the chain frame motor 9.

The slicing machine 1 comprises a sensor device 12, which, in this embodiment, is electrically connected to the chain frame motor 9. As described in more detail below, the sensor device 12 is designed to detect the current mounted status of the chain frame 10.

Furthermore, the sensor device 12 is connected to a control device 13 so as to transmit signals. The control device 13 is in turn connected to the chain frame motor 9 so as to control it and can switch it off and on via this connection. The control device 13 is also connected to the signal-issuing unit 14 and to the circular blade 4 so as to control them. A control program is executed on the control device 13 formed as a computing unit, by means of which the operation of the slicing machine 1 is monitored and controlled.

As can easily be seen from FIG. 1, the stop plate 5 cannot be moved to any desired extent in the x direction towards the chain frame 10, since, past a structure-dependent maximum movement position, the stop plate 5 would collide with the chain frame 10.

This is not a problem as long as only thin slices, in this embodiment slices less than 12 mm thick, are to be cut, as per a normal operating mode of the slicing machine 1. The chain frame 10 needs to be mounted on the machine housing 3 for correct deposition of the cut slices on the deposition table 11.

In order to cut thicker slices and also to sharpen the circular knife 4, in other words for a service mode of the slicing machine 1, the chain frame 10 must instead first be detached from the machine housing 3 before the stop plate 5 can be moved beyond the maximum movement position.

By means of the slicing machine 1 or the method according to the invention, as explained in more detail below, it can be ensured that the chain frame 10 is in the mounted status required in each case before the slicing machine 1 is operated in the particular operating mode.

In a first variant of the method, the normal operating mode and the service mode are alternately blocked or enabled on the basis of a status signal generated by the sensor device 12.

In this variant, the status signal is provided by the sensor device 12 of the control device 13.

For this purpose, as shown in FIG. 2, said sensor device is electrically connected to the chain frame motor 9 and comprises a current-measuring apparatus for measuring the chain frame motor current.

The mounted status is detected by the control device 13 first briefly activating the chain frame motor 9. The current-measuring apparatus of the sensor device 12 measures the chain frame motor current, which is used as a status signal in this method variant.

If said current exceeds a preset threshold value, the control program of the control device 13 registers this in a status memory of the control device 13 provided for this purpose as the presence of the chain frame 10 or as the mounted status in which the chain frame 10 is mounted. If the motor current falls below the threshold value, this is registered in the status memory as the mounted status in which the chain frame 10 has been detached.

If it is registered that the chain frame 10 is mounted, the normal operating mode is enabled, otherwise it is blocked. The service mode is inversely blocked or enabled.

Enabling and disabling an operating mode means that the control device 13 prevents it being possible for a blocked operating mode to be selected via the keypad and that, if the slicing machine 1 were in a blocked operating mode, said mode is ended.

Furthermore, if the operating mode is blocked, the control device 13 issues an acoustic signal via the signal-issuing unit 14 in order to draw the operator's attention to a visual information signal that is also displayed by the control device 13 via the display unit 15.

In this variant, the information signal is an information text, in which the operator is advised to mount or detach the chain frame 10 depending on the desired operating mode. However, the information signal and the acoustic signal are only issued when the target mounted status deviates from the actual mounted status.

After a preset time has elapsed, i.e. from 1 to 5 seconds, the current mounted status is then detected again to check whether the operator has followed the information from the information signal in the meantime.

If this is the case, the particular operating mode is enabled and can be used by the operator. In other words, in the service mode, the operator can then move the stop plate 5 beyond the maximum movement position and sharpen the circular knife 4 or cut a thick slice.

In a particularly advantageous variant, the service mode is split into a sharpening program and a thick-slices program for cutting slices of a predefined—large—minimum thickness.

In this variant or this embodiment, the control device 13 can move the stop plate 5 in the x direction in a manner operated by a motor. A sharpening device for sharpening the circular knife 4 can then be placed on the machine and activated so that the slicing machine 1 can then automatically execute the particular program (sharpening program or thick-slices program).

In the normal operating mode, the operator can set thin slices to be cut off from the material to be cut and placed on the deposition table 11.

In another alternative variant, the slicing machine comprises a locking apparatus, which allows or blocks the stop plate 5 from moving beyond the maximum movement position. For this purpose, the locking apparatus comprises an electrically actuable locking pin, which can be moved into or out of the movement path of the stop plate 5 in an electrically operated manner and in a manner controlled by the control device 13.

Furthermore, in this variant the control program is set up to activate or deactivate said locking apparatus on the basis of the mounted status registered or of the status signal, in order to thereby automatically allow or prevent movement beyond the maximum movement distance.

In another variant or another embodiment of the invention, the chain frame 10 comprises the first attachment point 21 and the second attachment point 22 (both shown in FIG. 2). In this embodiment or this method variant, the attachment points 21, 22 engage with contact switches fastened inside the machine housing 3. When the chain frame 10 is mounted, the contact switches are actuated or closed and, when the chain frame 10 is detached, the contact switches are opened.

The contact switches are therefore used as sensor devices 12, the control device 13 not requiring the chain frame motor 9 to start up briefly in order to query the mounted status, and the motor not starting up in this method variant. Therefore, part of the sensor device 12 is integrated in the particular attachment point in each case.

Another variant or another embodiment provides pins 23, 24. If the chain frame 10 is detached, the pins 23, 24 pass over roller switches, as a result of which a status signal is generated in a similar way to in the contact switches described above.

Another embodiment provides a magnet 25 on the chain frame 10. In the mounted status, a Hall-effect sensor is arranged on the machine housing 3 opposite said magnet, and acts as a sensor device 12. Depending on whether or not the chain frame 10 is mounted in this embodiment, an electrical signal is generated by the magnet 25 and the Hall-effect sensor, which signal is used as the status signal. The mounted status of the chain frame 10 is therefore determined without contact.

By means of said precautionary measures, according to the invention interruptions in the operating sequence of the slicing machine 1 can therefore be effectively prevented.

Figure 3:
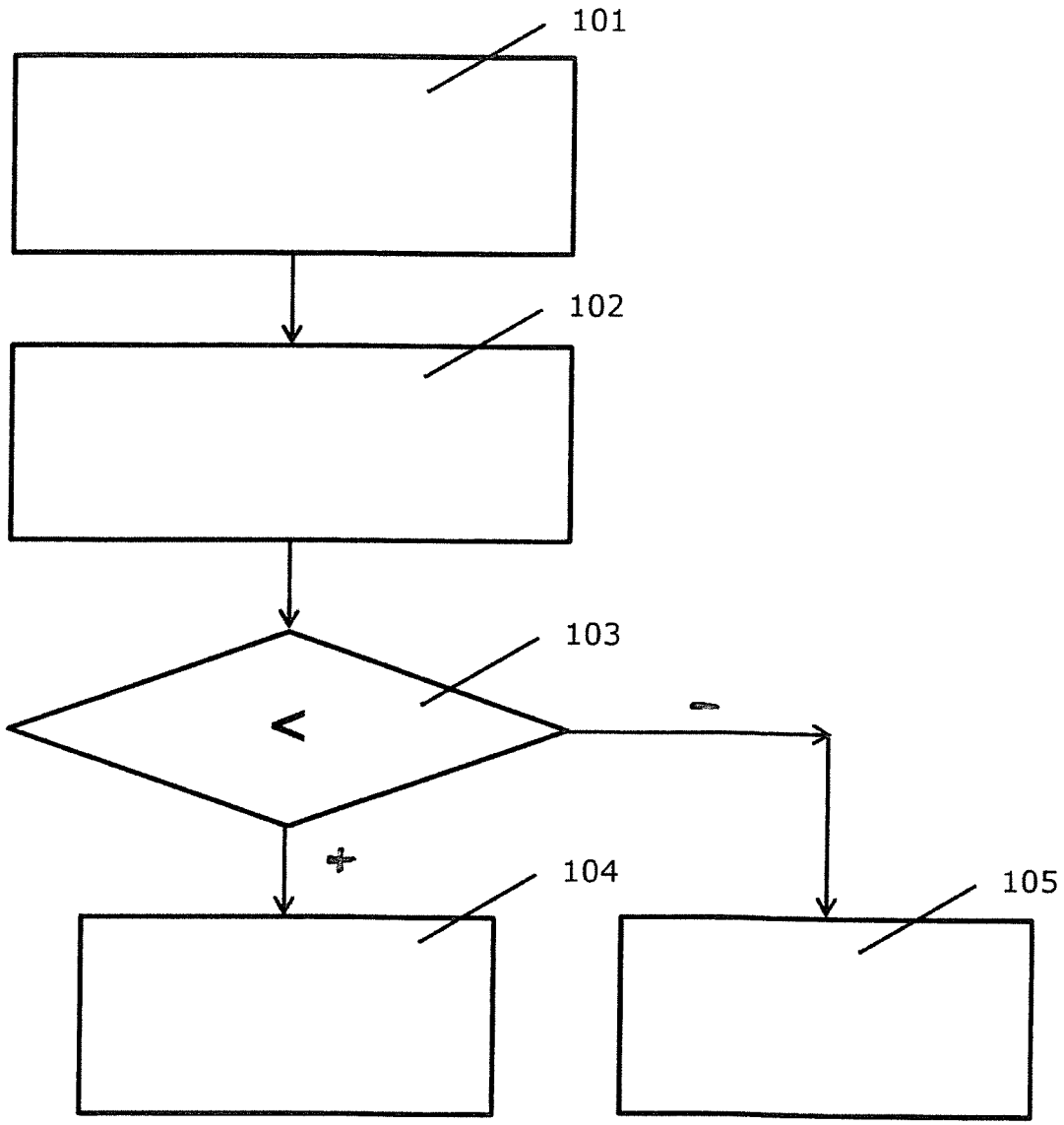
FIG. 3 is a schematic view of a method for controlling an electrically operated slicing machine.

A variant of the method according to the invention will now be explained in more detail on the basis of FIG. 3:

If the operator wanted to switch to the service mode, for example in order to cut thick slices, they would select or request the service mode in a first method step 101 by actuating a key of the keypad of the signal-issuing unit 14 that is assigned to the service mode.

In the next method step 102, the control device 13 then leaves the chain frame motor 9 to start up for a predefined measurement time, in this variant approximately 1 second.

Meanwhile, the sensor device 12 measures the average chain frame motor current. By means of a signal-transmitting connection, the measurement result is transmitted back to the control device 13. Once the predefined measurement time has elapsed, the control device 13 stops the chain frame motor 9.

In method step 103, the control device 13 checks whether the measured average chain frame motor current has fallen below a predefined threshold value, by comparing this value with the predefined threshold value. In this case, the chain frame motor current falling below the predefined threshold value is taken to signify a status signal indicating that the chain frame is mounted. In a similar way, said current not falling below said predefined threshold value is taken to signify a status signal indicating that the chain frame has been detached.

If said current falls below the predefined threshold value, method step 104 is carried out. This method pathway is marked by a "+" in FIG. 3. Alternatively, this means that, if the average chain frame motor current does not fall below the predefined threshold value, the method continues with method step 105. This method pathway is marked by a "–" in FIG. 3.

In method step 104, the control device 13 actuates the display unit 15 such that the message "Enable service mode" or, in an alternative embodiment of the method according to the invention, a text corresponding to such a message, is displayed on said display unit in the form of an enabling signal.

In addition, in this method variant the control unit 13 actuates a locking pin of a disabling apparatus, such that it does not engage in the movement path of the stop plate and the stop plate can move freely over a maximum movement path of the stop plate.

Therefore, the operator can now move the stop plate beyond the maximum movement path and cut thick slices using the slicing machine 1, for example.

In an alternative variant of the method, method step 104 does not provide displaying a message on the display unit 15. In other words, in this method variant, a corresponding blank message is provided on the display unit 105 as the enabling signal.

In method step 105, which is an alternative to method step 104, by contrast the control device 13 actuates the display unit 15 such that the message "Service mode blocked. Please detach chain frame before selecting the service mode" or, in an alternative embodiment of the method according to the invention, a text corresponding to such a message, is displayed on said display unit in the form of a disabling signal. In addition, an acoustic warning signal is issued by means of the signal-issuing unit 14.

In addition, in this method variant, the control unit 13 actuates a locking pin of a locking apparatus such that it engages in the movement path of the stop plate, and therefore the stop plate can only move as far as the maximum movement path of the stop plate, and not therebeyond.

Therefore, the operator can only move the stop plate as far as the maximum movement path. In this case, the maximum movement path is selected or the locking pin is positioned such that a collision between the stop plate and the chain frame is not possible.

In order to now be able to switch to the service mode, the operator is therefore forced to first detach the chain frame.

By carrying out the method again starting from method step 101, the operator can then select or request the service mode via the keypad so that the method according to the invention continues with method step 102 and the mounted status of the chain frame is correspondingly checked, after which the service mode is checked and enabled or blocked.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 slicing machine
2 cutting device
3 machine housing
4 circular knife
5 stop plate
6 bearing plate
7 bearing surface
8 carriage
9 chain frame motor
10 chain frame
11 deposition table
12 sensor device
13 control device
14 signal-issuing unit
15 display unit
17 slicers
18 transport chain
19 drive apparatus
20 motor coupling
21 first attachment point
22 second attachment point
23 first pin
24 second pin
25 magnet
101, 102, 103, 104, 105 method step
E cutting plane
X axis of rotation

The invention claimed is:

1. An electrically operated slicing machine for cutting slices of material to be cut, in particular elongate material to be cut, preferably food, comprising:

a cutting device, comprising a circular knife that is mounted in a machine housing and rotates in a cutting plane about a first axis of rotation;

a stop plate, which is parallel to the cutting plane and is movable in an x direction, for setting the cutting thickness;

a carriage, which supports a bearing plate having a bearing surface on which the material to be cut is placed, which carriage is configured to travel in parallel with the cutting plane; and a chain frame, which is operated by a chain frame motor, configured to deposit slices that have been cut off from the material to be cut on a deposition table, the chain frame being detachably connected to the machine housing, wherein the slicing machine comprises a sensor device configured to detect a current mounted status of the chain frame, wherein the slicing machine further comprises a control device, which is configured to control movement of the stop plate in the x direction for setting the cutting thickness, wherein the control device is configured to block the stop plate from moving beyond a set distance if the sensor device detects that the chain frame is currently mounted, so that the stop plate can only be moved beyond this set distance when the chain frame has been removed from the machine housing.

2. The slicing machine according to claim 1, further comprising a signal-issuing unit configured to display the current status signal of the chain frame.

3. The slicing machine according to claim 1, wherein the sensor device comprises a current-measuring apparatus.

4. The slicing machine according to claim 1, wherein the sensor device comprises a magnetic field sensor.

5. The slicing machine according to claim 1, wherein the sensor device comprises a mechanical switch configured to detect the current mounted status of the chain frame.

6. The slicing machine according to claim 5, wherein the mechanical switch comprises an electromechanical switch.

7. The slicing machine according to claim 1, wherein the chain frame is detachably attached to the machine housing via at least one attachment point, which comprises a pin or an eye.

8. The slicing machine according to claim 7, wherein at least part of the sensor device is integrated in the attachment point.

9. A method for controlling an electrically operated slicing machine for cutting slices of material to be cut, in particular elongate material, preferably food, the electrically operated slicing machine comprising a cutting device, which comprises a circular knife that is mounted in a machine housing and rotates in a cutting plane about a first axis of rotation; a stop plate, which is parallel to the cutting plane and is movable in an x direction, for setting the cutting thickness; a carriage, which supports a bearing plate comprising a bearing surface on which the material to be cut is placed, which carriage is configured to travel in parallel with the cutting plane; and a chain frame, which is operated by a chain frame motor, configured to deposit slices that have been cut off from the material to be cut on a deposition table, the chain frame being detachably connected to the machine housing, the method comprising: enabling or blocking an operating mode of the slicing machine on the basis of a status signal from a sensor device configured to detect the current mounted status of the chain frame, wherein the stop plate is blocked from moving beyond a set distance based upon the status signal indicating that the chain frame is currently mounted, so that the stop plate can only be moved beyond this set distance when the chain frame has been removed from the machine housing.

10. The method according to claim 9, wherein, in the blocked operating mode, a disabling signal or, in the enabled operating mode, an enabling signal, is displayed to on a display unit.

11. The method according to claim 9, wherein the sensor unit comprises a current-measuring apparatus configured to measure a current of the chain frame motor.

12. The method according to claim 11, wherein the operating mode is selectable from one of a plurality of modes, the modes comprising a normal operating mode for cutting slices below a threshold thickness, and a service mode, the service mode comprising a sharpening program or a movement of the stop plate to a distance for cutting slices above the threshold thickness, wherein the service mode is enabled for selection as the operating mode when the current of the chain frame current is measured as being below a predefined current value.

13. The method according to claim 9, wherein, when a status signal from the sensor device indicates that the chain frame is currently mounted, movement of the stop plate beyond a set distance is automatically blocked, and wherein the stop plate can only move beyond this set distance when the chain frame has been removed from the machine housing.

14. The slicing machine according to claim 2, wherein the signal-issuing unit comprises a visual display unit.

15. The slicing machine according to claim 3, wherein the current-measuring apparatus is configured to measure the chain frame motor current.

16. The slicing machine according to claim 4, wherein the magnetic field sensor comprises a Hall-effect sensor.

17. The slicing machine according to claim 4, wherein the magnetic field sensor is configured to interact with a magnet mounted on the chain frame.

18. The slicing machine according to claim 6, wherein the electromechanical switch comprises a roller switch or a contact switch.

19. The method according to claim 9, wherein the operating mode is selectable from one of a plurality of modes, the modes comprising a normal operating mode for cutting slices below a threshold thickness, and a service mode, the service mode comprising a sharpening program or a movement of the stop plate to a distance for cutting slices above the threshold thickness, wherein the service mode is either enabled or blocked from being selected as the operating mode based on the status signal.

* * * * *